United States Patent [19]

Rembold et al.

[11] 4,384,828

[45] May 24, 1983

[54] SLIDING VANE COMPRESSOR

[75] Inventors: Helmut Rembold, Stuttgart; Ernst Linder, Mühlacker; Manfred Ruoff, Stuttgart; Hubert Dettling, Waiblingen; Jürgen Werner, Möglingen, all of Fed. Rep. of Germany

[73] Assignee: Robert Bosch GmbH, Stuttgart, Fed. Rep. of Germany

[21] Appl. No.: 178,708

[22] Filed: Aug. 12, 1980

[30] Foreign Application Priority Data

Sep. 21, 1979 [DE] Fed. Rep. of Germany ..... 2938276

[51] Int. Cl.[3] ..... F04B 35/04; F04C 29/02; F04C 29/08

[52] U.S. Cl. ..... 417/356; 418/75; 418/77; 418/100; 418/102; 418/152; 418/178; 418/184; 418/185; 418/188

[58] Field of Search ..... 417/410, 356, 354, 355; 418/185, 188, 100, 98, 99, 97, 102, 152, 184, 75, 77

[56] References Cited

U.S. PATENT DOCUMENTS

| | | | |
|---|---|---|---|
| 1,953,253 | 4/1934 | Ogilive | 418/97 |
| 2,670,894 | 3/1954 | Warrick et al. | 417/356 |
| 3,184,157 | 5/1965 | Galin | 418/185 |
| 3,519,371 | 7/1970 | Holland et al. | 418/152 |
| 3,697,202 | 10/1972 | Reinhart et al. | 418/142 |
| 3,881,849 | 5/1975 | Commarmot et al. | 418/152 |
| 3,945,776 | 3/1976 | Morita | 418/142 |
| 4,164,690 | 8/1979 | Müller et al. | 417/410 |
| 4,247,263 | 1/1981 | Pech et al. | 418/152 |
| 4,255,100 | 3/1981 | Linder | 417/410 |

FOREIGN PATENT DOCUMENTS

| | | | |
|---|---|---|---|
| 1198685 | 7/1970 | United Kingdom | 417/410 |

*Primary Examiner*—John J. Vrablik
*Assistant Examiner*—Peter M. Cuomo
*Attorney, Agent, or Firm*—Michael J. Striker

[57] ABSTRACT

A sliding vane compressor for use in refrigeration systems includes a rotatable hollow shaft, a cylindrical compressor rotor which surrounds the shaft, end covers enclosing the compressor rotor and a pair of vanes disposed within the rotor to compress a working medium entering the rotor. The compressor rotor and end covers have end faces in a contact area therebetween. At at least one of end faces of either rotor or end cover, a number of spirally-shaped grooves are formed curved in the direction of rotation of the rotor shaft. These grooves extend from the periphery of the respective end face toward the center thereof but short of said center to produce a flow preventing leakage of the working medium between the low pressure region and the high pressure region in the compressor.

26 Claims, 9 Drawing Figures

SLIDING VANE COMPRESSOR

BACKGROUND OF THE INVENTION

This invention relates to refrigeration equipment and more particularly to sliding vane compressors utilized in freon refrigeration systems.

The sliding vane compressors of the foregoing type normally include a compressor rotor in which end faces of the rotor are enclosed by end covers which should tightly engage the rotor end faces. The rotor is usually provided with a number of vanes for compressing a working medium such as freon which enters the rotor from a suction low pressure area and is discharged therefrom to the high pressure area. It is rather difficult to provide a sealing between the end faces of the rotor and end covers which is tight enough to prevent the working medium and lubrication utilized in the compressor equipment from penetration from the high pressure area back into the low pressure area. As a result of this a lubricating oil used in the compressors should be separated from the working medium leaving the compressor. Furthermore, the occurence of oil film on the end faces of the rotor may result in friction losses in the equipment.

SUMMARY OF THE INVENTION

It is therefore an object of the present invention to avoid the disadvantages of the prior art sliding vane compressors.

More particularly, an object of the invention is to provide an improved sliding vane compressor in which oil waste and friction losses are minimized.

In pursuance of this object and others which will become apparent hereafter, a sliding vane compressor comprises a rotatable hollow shaft having an interior, a cylindrical compressor rotor surrounding the shaft and having a set of first end faces, end covers enclosing the rotor and having a set of second end faces abutting the first end faces, the end faces of the first and the second set each having a center and an outer periphery, and at least two vanes disposed in the rotor and adapted to compress a working medium. The vanes are provided with valve means to control a medium flowing from a low pressure region. The end faces of at least one of the sets are formed with a plurality of grooves which are curved in the direction of rotation of said shaft and extend from the outer periphery of the respective end face toward the respective center but short of said center.

The set of end faces formed with a plurality of grooves may be provided on the rotor.

The set of end faces formed with a plurality of grooves may be also provided on the end covers.

The grooves may be spirally-shaped riffles.

The hollow shaft may have a first end portion and a second end portion, the end covers having openings for receiving said end portions to form a contact area therebetween, the end portions are formed with a plurality of spirally-shaped grooves in this contact area.

The contact area may include a portion which is groove-free.

The spirally-shaped grooves formed on said first end portion and said second end portion may be directed in downward direction from the rotor toward the respective opposite ends of the shaft.

These grooves of each of the end portions may also be directed in an upward direction toward the respective opposite ends of the shaft.

The spirally-shaped grooves of each end portion may include a first set of the grooves and a second set of the grooves, the first set of the grooves is directed in an upward direction from the rotor toward the respective end of the shaft whereas the second set of the grooves is directed in a downward direction from the rotor toward the respective end of the shaft.

A certain amount of lubricating oil may be added to the working medium, as for example, in proportion 1:10.

The compressor may be further provided with a housing to accommodate the compressor rotor, end covers and the vanes.

The compressor may further include a pressure chamber disposed between the end portions of the shaft and associated with the interior of the shaft.

The compressor may be further provided with a motor having a stator surrounding the compressor rotor, a motor rotor, and a permanent magnet, the stator being located within the housing of the compressor.

A motor provided in the compressor may be a synchronous motor.

The motor may be provided with a cup-shaped enclosure which is rigidly connected to the motor rotor.

The end portions of the shaft may be axially outwardly projecting from the central pressure chamber.

The end portions of the shaft may be connected to said enclosure.

The casing of the compressor rotor may be suspended from the outer housing by a spring element.

The compressor rotor, the vanes and a compressor rotor casing may be made of ceramic plastic material.

The vanes of the compressor may be coated with molybdenum or with molybdenum sulfide.

Each of the end portions of the shaft may include an elongated bore being in communication with the central pressure chamber.

The spirally-shaped grooves of the end portions of the shaft may be associated with the central pressure chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
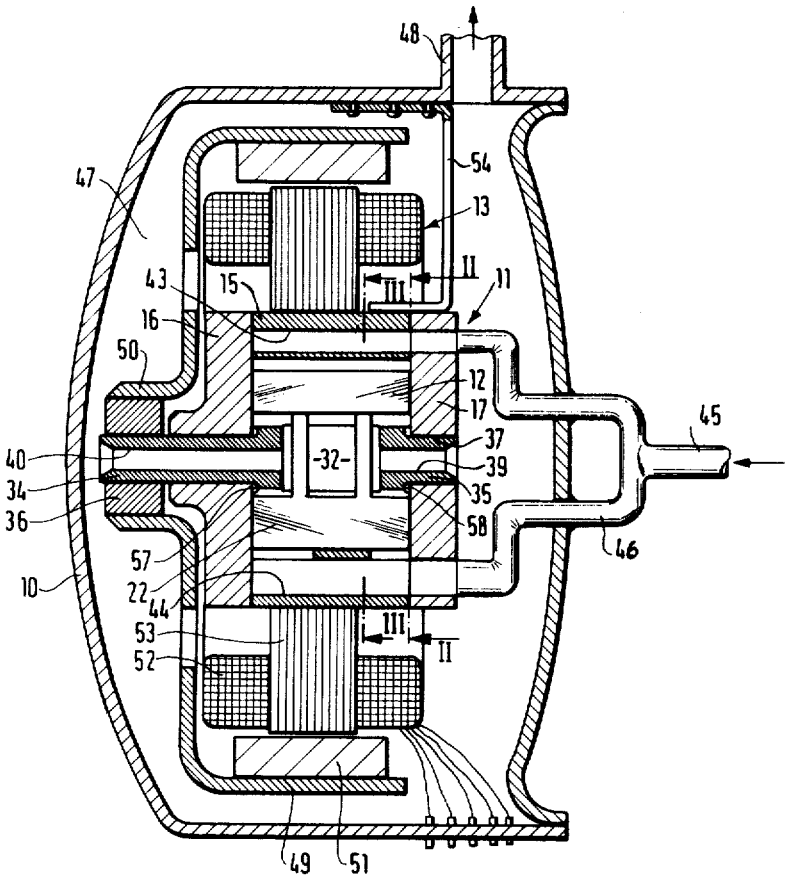
FIG. 1 is an elevational sectional view of a compressor according to the invention.
Figure 2:
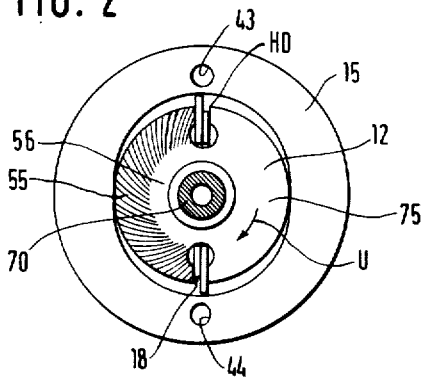
FIG. 2 is a sectional view taken along line II—II of FIG. 1.
Figure 3:
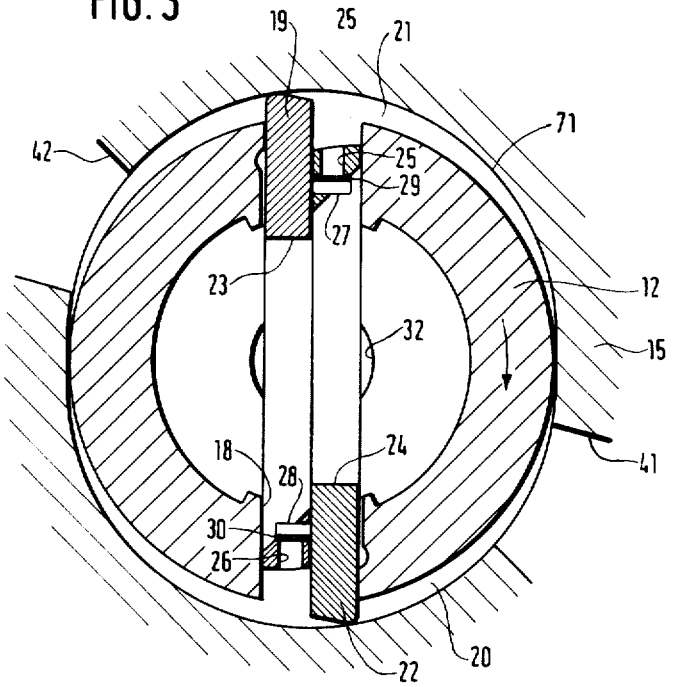
FIG. 3 is an enlarged sectional view taken along line III—III of FIG. 1.

Referring to the drawings, and first to FIGS. 1-3, a sliding vane compressor generally denoted as 11 includes a rotor 12 and an electromotor 13 which may be a synchronous motor. The rotor 12 and electromotor 13 are accommodated in a casing 10. The rotor 12 has an outer housing ring 15 closed with two end covers 16 and 17. As can be seen in FIGS. 2 and 3, the rotor 12 is formed with a slot 18 in which two vanes 19 and 22 are accommodated. The rotor 12 is mounted on a rotatable hollow shaft 70 which has two oppositely directed end portions 34 and 35. A central pressure chamber 32 is positioned between end portions 34 and 35. The vanes 19 and 22 are mounted adjacent to each other and have radially outwardly extending ends projecting toward the inner surface of an opening 71 of substantially oval shape made in the housing ring 15. The outwardly extending ends of the vanes 19 and 22 form in the opening of the ring 15 two crescent-shaped working passages 21 and 20.

The vanes 19 and 22 have in the middle thereof central openings 23 and 24 respectively. Each vane is furthermore provided with a radially extended opening 25, 26 and a relatively small chamber 27, 28. Each opening 25, 26 is connected to the respective chamber 27 or 28 by means of blade-shaped valves 29 and 30, respectively. The valves 29 and 30 serve to control the amount of working medium flowing from the crescent-shaped passages 21 and 20 into the interior of the shaft 70 via the openings 23, 24 and the central pressure chamber 32.

The end portions 34, 35 of the rotor shaft 70 of which the portion 34 is positioned in a friction bearing 36, and the portion 35 is disposed in a central opening 37 of the cover 17 which may have a bearing surface, have elongated concentric openings 39 and 40 associated with the central pressure chamber 32.

The passages 21 and 20 are arranged in communication with recesses 41 and 42 respectively which are associated with elongated openings 43, 44 provided in the ring 15 and shown in FIGS. 1 and 2. The openings 43 and 44 serve to receive a working medium from a supply-conduit 46 which in turn is connected to a suction inlet 45.

The opening 40 of the shaft end portion 34 is associated with the interior 47 of the compressor casing 10. The suction inlet 45 is projecting into the casing 10, which casing is provided with an outlet 48 into which the compressed working medium is discharged to be thereafter used in a consumption unit (not shown). The shaft 70 is connected to a cup-shaped rotor 50 through the friction bearing 36. Rotor 50 is a part of the electromotor 13. A permanent magnet 51 is mounted on two flanges of the inner wall of the rotor 50. Two windings 52 of a stator 53 of the electromotor 13 are rigidly mounted on the housing ring 15. The compressor rotor 12 is connected to the rotor 50 of the electromotor by means of a plate member 49. The housing ring 15 of the compressor rotor 12 is supported on the housing 10 by means of a blade spring 54.

FIG. 2 shows an end face 75 of the rotor 12 which is formed with a plurality of radially extending grooves 55. The grooves 55 extend from the outer periphery of the rotor 12 toward the center thereof. As may be seen in FIG. 2, the grooves do not reach the center of the rotor 12 but terminate short of said center to provide a groove-free area 56. The grooves 55 are curved in the direction of rotation of the rotor as shown by arrow U. The opposite end face of the rotor 12 is provided with similar grooves formed on a surface which in assembly is in contact with the end face of the end cover. Similar grooves may be formed on the end faces of the end covers 16 and 17. Grooves 57 and 58 are formed in the end faces of the rotors at the transition area between the rotor and end portions 34, 35 shown in FIG. 4.

Grooves 55 may be formed as spirally-shaped riffles of relatively small depth.

Figure 4:
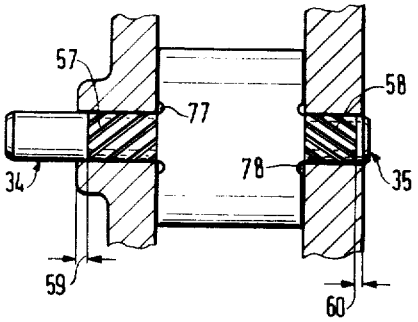
FIGS. 4–7 are enlarged sectional views showing the end portions of a compressor shaft mounted in the end covers and formed with grooves of different embodiments.
Figure 5:
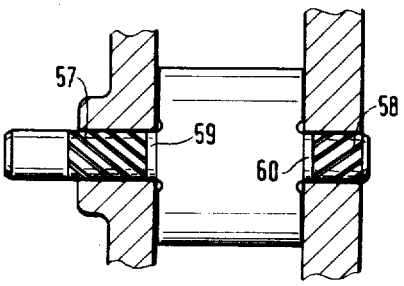
Figure 6:
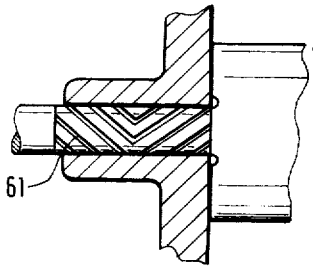
Figure 7:
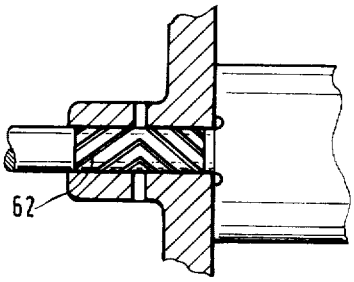
Figure 8:
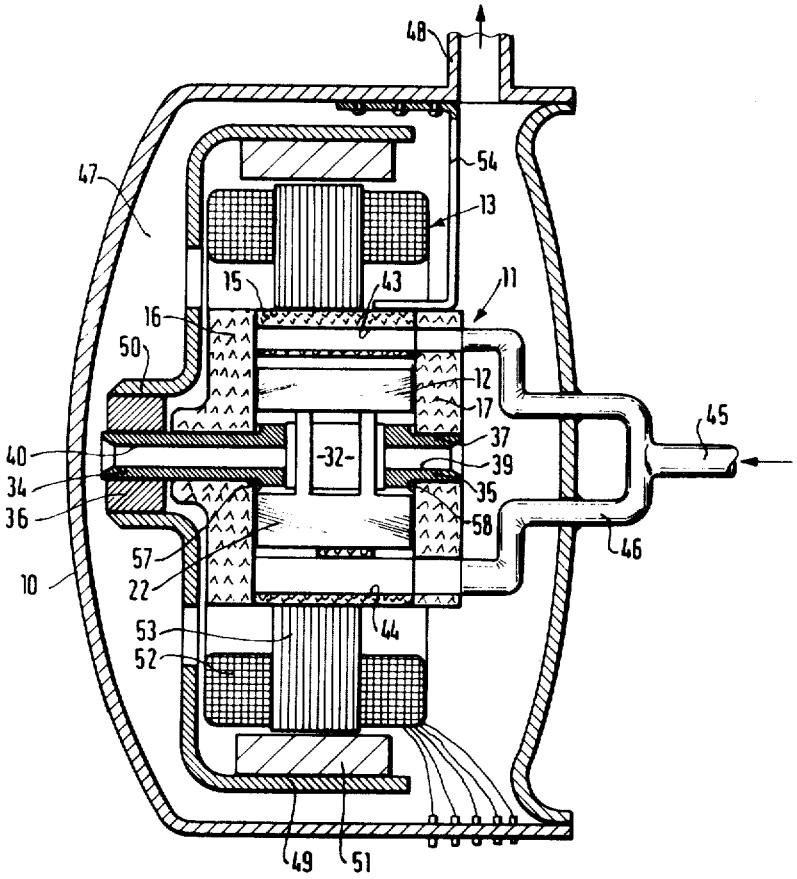
FIGS. 8 and 9 are elevational and sectional views corresponding to those of FIGS. 1 and 2, respectively, but illustrating a rotor of the compressor formed of ceramic material.
Figure 9:
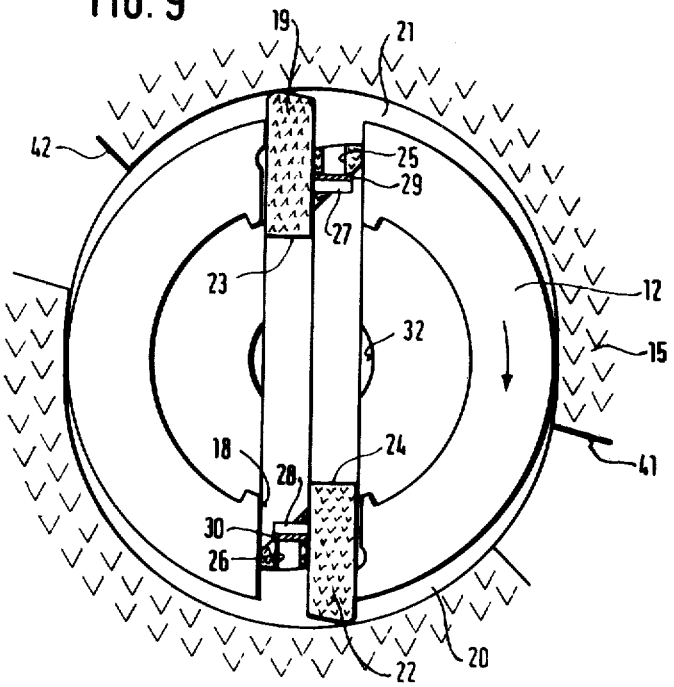
Figure 10:
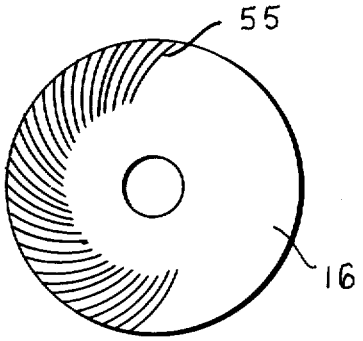

Referring to FIGS. 4–7, the end portions 34 and 35 of the shaft 70 are shown in assembly with the end covers 16 and 17. FIGS. 4–7 illustrate different embodiments of the grooves formed on the outer surfaces of the end portions 34, 35 at an area of contact between the end portions and the end covers. A number of spirally-shaped grooves 57, 58 are formed on each end portion which extend axially outwardly from the respective end faces of the rotor 12. The grooves are made on the bearing surface of the end portion 34, 35, which surface has a portion designated by 59 or 60 which constitutes a groove-free or throttle zone. The groove-free zone may be provided either at the side facing the end of the rotor or the side opposite to that face. The grooves 57 may extend axially beyond the contact area between the end portions and end covers as shown in FIGS. 5 and 6. The spiral grooves 57, 58 may be directed in a downward outward direction from the rotor towards the opposite ends of the shaft as shown in FIG. 4 or may project in an upward outward direction from the rotor 12 towards the opposite ends of the shaft as shown in FIG. 5. The spiral grooves formed on the end portions of the shaft may also have a fishbone-profile denoted by 61 or 62 in FIGS. 6 and 7. In this structure one set of the grooves is projected to the right towards the rotor upwardly and the other set of the grooves is directed upwardly to the left (FIG. 6). In the embodiment shown in FIG. 7 one set of the grooves is directed downwardly to the right toward the rotor 12 and the other set of the grooves is extended downwardly to the left towards the left end of the end portion 34.

The spiral grooves 57, 58 are arranged in communication with the central pressure chamber 32 by means of transition grooves 77, 78. By provision of spiral grooves 57, 58 the bearing surfaces of the shaft end portions are constantly lubricated by the compressed working medium such as freon vapor so that the additional lubrication in the contact area between the shaft and end covers is not needed. The groove-free or throttle zones 59, 60 prevent pressure in the central chamber 32 from being reduced.

In operation, a working fluid such as freon vapor enters the suction inlet 45 from which it flows into the conduit 46 and then into the elongated openings 43, 44 of the housing ring 15. The vapor thereafter flows into slots 41, 42 formed in the ring 15, which slots are associated with working passenges 21, 22 to which the vapor flow is directed. Upon rotation of the rotor 12 caused by the electromotor 13, the refrigerant is compressed by vanes 19, 22 and pushed by centrifugal forces exerted in the rotor through the valves 29, 30 to enter the openings 23, 24. The compressor refrigerant is then directed into the central pressure chamber 32 from which it flows through openings 39, 40 of end portions 34, 35 into the interior of the casing 10 to be discharged therefrom via the outlet 48. It is to be understood that the interior of the rotor is associated with the low pressure area whereas the interior of the end portions 34, 35 and thus the chamber formed in the casing 10 are communicated with the high pressure area. The clearance between the end faces of the end portions 34, 35 and the end covers 16, 17 is therefore permanently under compressing forces developed in the contact area therebetween. These compressing forces may cause vapor leakage from the high pressure zone to the low pressure zone, which is undesirable. This leakage can be substantially reduced by provision of the spirally-shaped grooves 55 on the end face of either rotor 12 or end covers 16 or 17. When the rotor is rotated the grooves 55 curved in the direction of rotation of the rotor generate an additional vapor stream which counteracts the leaking vapor stream so that the leaking vapor flow is directed to the throttle or groove-free zone 56. Back-pressure is originated in the throttle zone which increases the bearing capacity of the contacting end faces of the rotor 12 and the end covers 16, 17. By provision of the grooves 55 pressure in the area between the end faces of the rotor and the end covers will be reduced so that the undesirable vapor leakage from the high pressure zone to the low pressure zone will be minimized.

It will be understood that each of the elements described above, or two or more together, may also find a useful application in other types of constructions differing from the types described above.

While the invention has been illustrated and described as embodied in a sliding vane compressor it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sliding vane compressor, particularly for use in freon refrigeration system, comprising a rotatable hollow shaft having an interior; a cylindrical compressor rotor surrounding said shaft and having a set of first end faces; end covers enclosing said compressor rotor and having a set of second end faces abutting said first end faces, said end faces of said first and said second set each having a center and an outer periphery, said rotor being associated with a low pressure region of the compressor, said interior of said shaft being associated with a high pressure region of the compressor; and at least two vanes disposed in said rotor and adapted to compress a working medium, said vanes having valve means to control a medium flowing from the low pressure region, the end faces of at least one of said sets being formed with a plurality of grooves, said grooves being curved in the direction of rotation of said shaft and extending substantially radially from the outer periphery of the respective end face toward but short of the respective center to thereby prevent leakage of the working medium between the low pressure region and the high pressure region.

2. The compressor of claim 1, wherein said set of end faces formed with a plurality of said grooves is provided on said rotor.

3. The compressor of claim 1, wherein said set of end faces formed with a plurality of said grooves is provided on said end covers.

4. The compressor of claim 2, wherein said grooves are spirally-shaped riffles.

5. The compressor of claim 3, wherein said grooves are spirally-shaped riffles.

6. The compressor of claim 1, wherein said hollow shaft has a first end portion and a second end portion, said end covers have openings for receiving the end portions to form a contact area therebetween, said end portions each being formed with a plurality of spirally-shaped grooves at said contact area.

7. The compressor of claim 6, wherein each of the end portions includes a portion which is groove-free.

8. The compressor of claim 6, wherein said spirally-shaped grooves of said first end portion and said second end portion are directed respectively in a downward direction from said rotor toward the respective opposite ends of said shaft.

9. The compressor of claim 6, wherein said spirally-shaped grooves of said first end portion and said second end portion are directed respectively in an upward direction toward the respective opposite ends of said shaft.

10. The compressor of claim 6, wherein said spirally-shaped grooves of said first end portion and said second end portion each including a first set of said spirally-shaped grooves and a second set of said spirally-shaped grooves, the grooves of said first set being directed in an upward direction from said rotor toward the respective end of the shaft whereas said second set being directed in a downward direction from said rotor toward the respective end of the shaft.

11. The compressor of claim 1, wherein lubricating oil is added to the working medium.

12. The compressor of claim 11, wherein the lubricating oil added to the working medium is in proportion of 1:10 of the working medium.

13. The compressor of claim 1, further comprising a ring-shaped casing to accommodate said compressor rotor, and an outer housing in which said ring-shaped casing, said end covers and said vanes are located, said housing being provided with an inlet to receive the working medium and an outlet to discharge the working medium.

14. The compressor of claim 6, further including a pressure chamber disposed between said end portions of said hollow shaft and being associated with said interior of said shaft.

15. The compressor of claim 14, further comprising a motor having a stator surrounding said compressor rotor, a permanent magnet and a motor rotor, said motor being located within said housing.

16. The compressor of claim 14, wherein said motor is a synchronous motor.

17. The compressor of claim 14, further comprising an enclosure surrounding said motor, said enclosure having a cup-shaped form and being rigidly connected to said motor rotor.

18. The compressor of claim 17, wherein said end portions of said shaft are outwardly axially projecting from said central pressure chamber.

19. The compressor of claim 18, wherein said enclosure is connected to said end portions of said shaft.

20. The compressor of claim 19, further comprising a spring element, said casing of said rotor being suspended from said outer housing by said spring element.

21. The compressor of claim 19, wherein said compressor rotor, said vanes and said rotor casing are formed of ceramic material.

22. The compressor of claim 20, wherein said vanes are coated with polyamide.

23. The compressor of claim 20, wherein said vanes are coated with molybdenum.

24. The compressor of claim 20, wherein said vanes are coated with molybdenum sulfide.

25. The compressor of claim 20, wherein said end portions of said shaft each include an elongated bore to form said interior of said shaft, said elongated bores being connected to said central pressure chamber.

26. The compressor of claim 20, wherein said spirally-shaped grooves of said end portions are associated with said central pressure chamber.

* * * * *